US009095181B1

(12) United States Patent
Plant

(10) Patent No.: US 9,095,181 B1
(45) Date of Patent: Aug. 4, 2015

(54) SHOULDER AND UPPER ARM DRAPING BURP CLOTH

(71) Applicant: Haylie Anne Plant, San Antonio, TX (US)

(72) Inventor: Haylie Anne Plant, San Antonio, TX (US)

( * ) Notice: Subject to any disclaimer, the term of this patent is extended or adjusted under 35 U.S.C. 154(b) by 0 days.

(21) Appl. No.: 14/468,991

(22) Filed: Aug. 26, 2014

Related U.S. Application Data

(60) Provisional application No. 61/870,124, filed on Aug. 26, 2013.

(51) Int. Cl.
*A41D 27/12* (2006.01)
*A41B 13/10* (2006.01)

(52) U.S. Cl.
CPC ..... *A41D 27/12* (2013.01); *A41B 13/10* (2013.01)

(58) Field of Classification Search
CPC ..... A41D 1/205; A41D 3/08; A41D 1/22; A41D 15/002; A41D 1/20
USPC ..... 2/46, 48, 50, 49.1–49.5, 69.5, 70, 459, 2/102
See application file for complete search history.

(56) References Cited

U.S. PATENT DOCUMENTS

| | | | | | |
|---|---|---|---|---|---|
| 2,482,182 | A | * | 9/1949 | Henninger | 2/48 |
| 2,727,239 | A | | 12/1955 | Simon | |
| 2,793,367 | A | | 5/1957 | Hart | |
| 2,955,293 | A | * | 10/1960 | Peterson | 2/48 |
| 3,024,466 | A | * | 3/1962 | Agostini | 2/48 |
| 4,050,099 | A | | 9/1977 | David | |
| 4,285,067 | A | | 8/1981 | David | |
| 4,356,570 | A | * | 11/1982 | Vernon et al. | 2/16 |
| D361,878 | S | * | 9/1995 | Chadwell | D2/861 |
| 5,802,610 | A | | 9/1998 | Burr | |
| 6,028,241 | A | | 2/2000 | Armstead | |
| 7,082,617 | B1 | * | 8/2006 | Poindexter et al. | 2/48 |
| 7,316,035 | B2 | * | 1/2008 | Archambault | 2/46 |
| 7,765,609 | B2 | * | 8/2010 | Chase | 2/46 |
| D623,383 | S | * | 9/2010 | Rojas | D2/863 |

* cited by examiner

*Primary Examiner* — Tejash Patel
(74) *Attorney, Agent, or Firm* — Dykema Gossett P.L.L.C.

(57) ABSTRACT

A symmetrical, reversible burp cloth may have a multi-layered body portion, a shoulder drape section, a front drape section, and a back drape section. All sections may be connected to form a shoulder saddle. A sleeve seam may extend along an outer edge of the shoulder saddle. An upper arm drape section may be affixed to the sleeve seam and may extend outwardly and depend downwardly at least to a mid-bicep region of the user when the cloth is in use. A nursing cover may be attachable to and detachable from the burp cloth. In some embodiments, a burp cloth may double as a nursing cover.

7 Claims, 8 Drawing Sheets

SHOULDER AND UPPER ARM DRAPING BURP CLOTH

CROSS-REFERENCE TO RELATED APPLICATION

This application claims priority to U.S. Provisional Patent Application No. 61/870,124 filed Aug. 26, 2013, the entire disclosure of which is incorporated herein by reference.

FIELD

The present application relates to a baby "burping" cloth. More particularly, it relates to a reversible, symmetrical burp cloth for protecting a user's underlying garments from soiling.

BACKGROUND

It is well known that after feeding an infant or a young baby with liquids, the baby is often placed at the caregiver's shoulders and "burped." It is common for the baby to regurgitate a portion of the liquid and whatever else is in the child's stomach. The caregiver will normally wear a burp cloth or other shoulder-supported article to avoid soiling the caregiver's underlying garments.

One of the main difficulties with existing burp cloths known in the prior art is that they slip from the shoulder area and seldom cover the caregiver's upper arm, e.g., the bicep region. While many attempts have been made to improve these burp cloths, including providing cloths that are made of water-proof materials, that may be disposable, that incorporate multiple layers of fabric, and the like, the problem of slippage continues to be bothersome.

The following is a listing of some prior attempts to solve these problems: U.S. Pat. Nos. 2,727,239; 2,793,367; 2,955,293; 4,050,099; 4,285,067; 5,802,610; 6,028,241; and 7,316,035.

SUMMARY

A burp cloth as described herein may have an improved configuration including an upper arm drape section or sleeve adapted to extend generally outwardly along a longitudinal axis of a middle part of the user's shoulder and depend downwardly to a mid-bicep region of the user's arm. Some embodiments of the present burp cloth, sometimes herein referred to as "The Baby Sleeve," may incorporate a draped sleeve portion to provide additional coverage and stability. Further, the body portion of the burp cloth may have a shoulder drape section, a front drape section, and a back drape section which are connected to form a shoulder saddle to fit over the user's shoulder when the burp cloth is in use. The shoulder saddle may have an arcuate inner portion for contouring around the user's neck when in use.

BRIEF DESCRIPTION OF THE DRAWINGS

The present invention will be readily understood by those skilled in the art by reference to the following drawings in conjunction with the accompanying specification.

DETAILED DESCRIPTION

Figure 1:
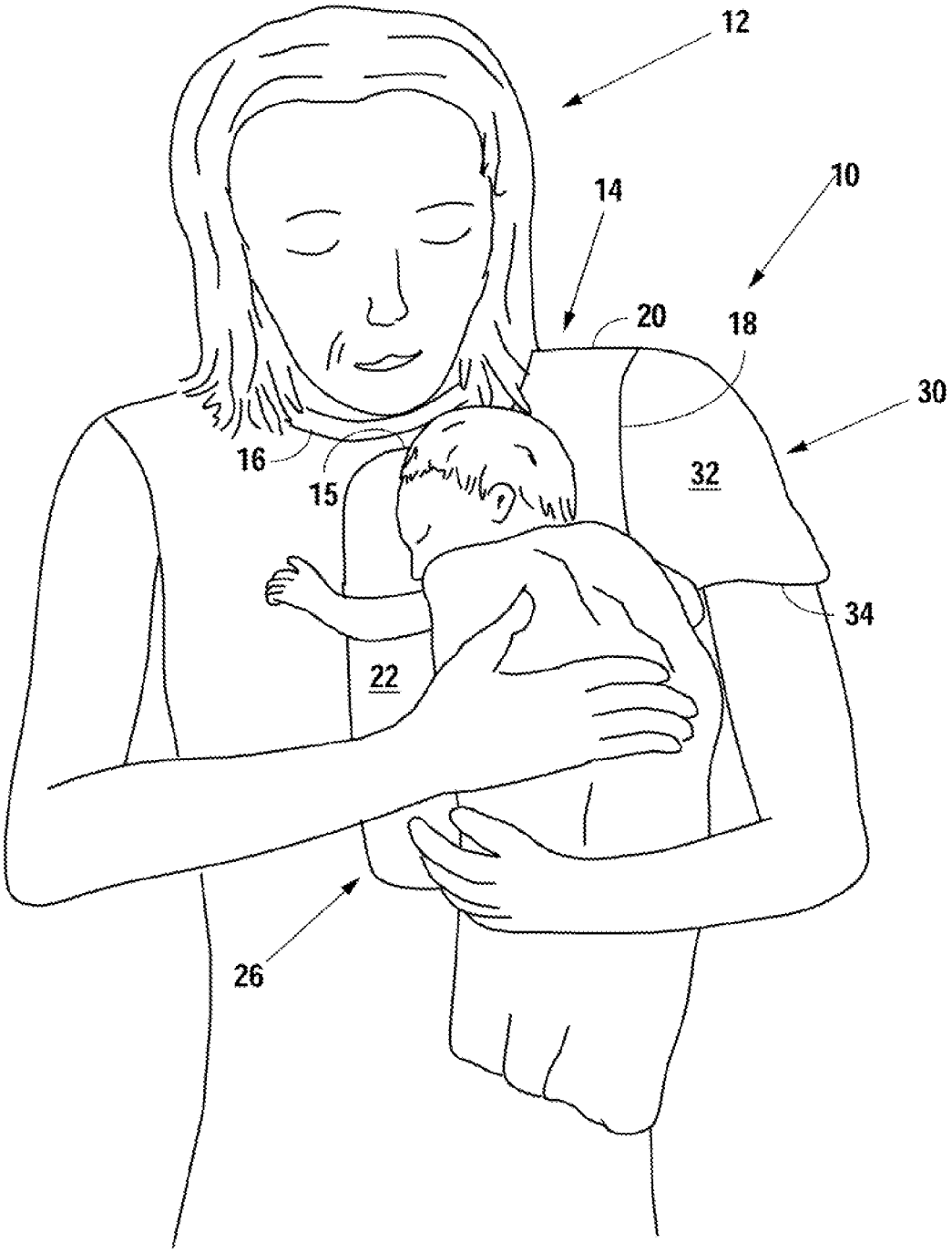
FIG. 1 is a perspective view illustrating a caregiver or user wearing and using a shoulder and upper arm draping burp cloth, which is shown in cross-hatching.

Referring now specifically to the drawings, an embodiment of a draping burp cloth as described herein is generally designated by reference numeral 10, and, as illustrated in FIG. 1, it may be used by a caregiver 12 by placing it over a shoulder region 14 with one edge 15 of the cloth adjacent the neck 16. At an opposite side is an upper arm drape section or sleeve 32 affixed to a sleeve seam 18 located at or near the juncture between the upper arm (e.g., bicep) and shoulder of the person 12 using the burp cloth ("the user").

Figure 7:
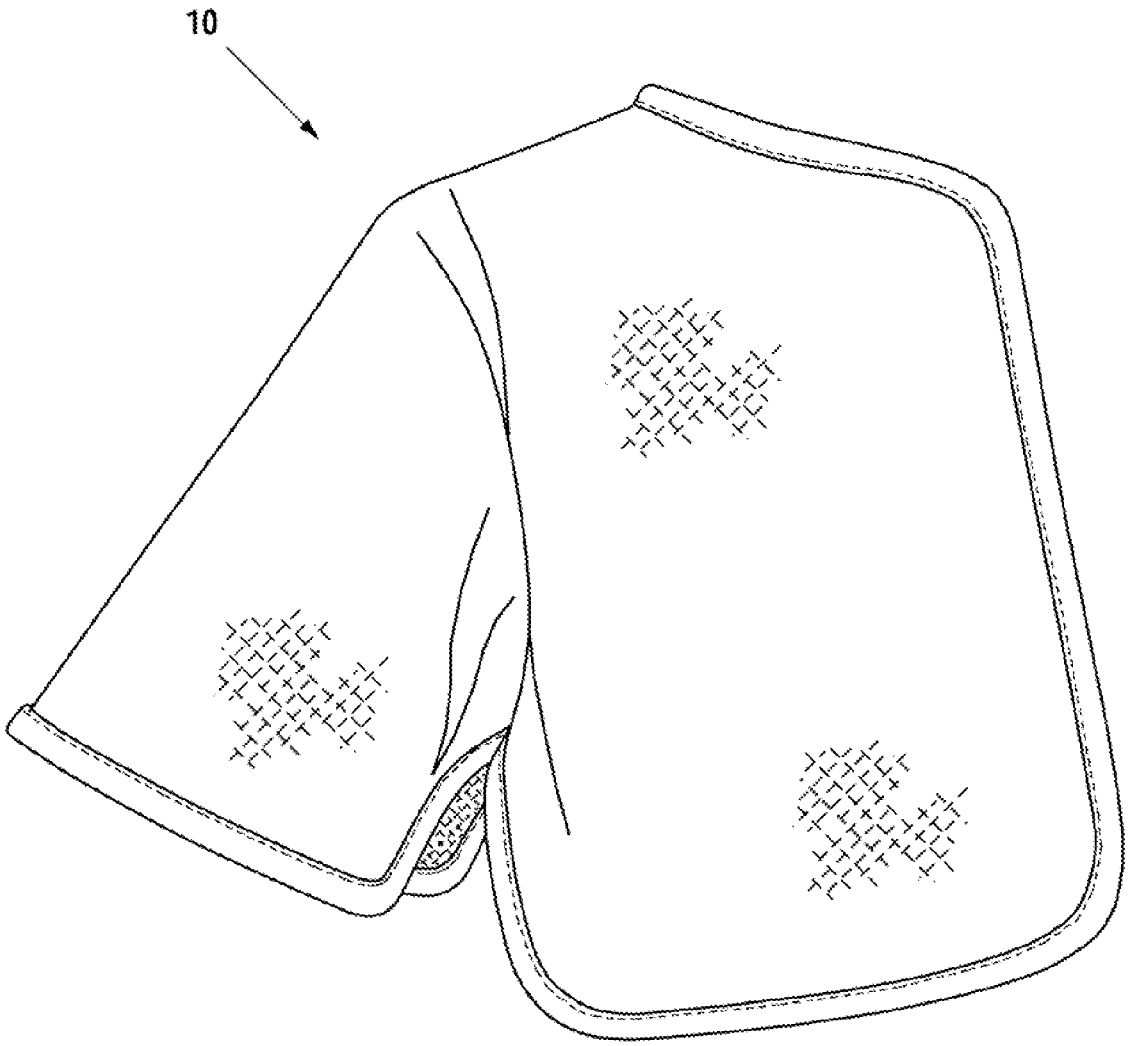
FIG. 7 is a front perspective view of a burp cloth draped on a mannequin in a burping position.

FIG. 1 illustrates how burp cloth 10 may be worn and used. The burp cloth 10 drapes over the user's shoulder 14. When the parent or caregiver 12 is using the burp cloth 10, the shoulder drape section 19 (see FIG. 3) of the burp cloth 10 sits on the middle part 20 of the user's shoulder 14, and the front portion 22 and back portion 24 (see FIG. 3) of the burp cloth 10 hang down to the front mid-chest region 26 and the mid-back area, respectively. The shape of body portion 40 (see FIGS. 2 and 3) may be designed around the contours of the human shoulder and neck region. It may be designed to drape over the shoulder, the chest, and the back areas thereby creating a shoulder saddle while curving around the base of the neck 16. This shape and construction of burp cloth 10 protects the user's underlying clothing from being soiled by regurgitated fluids. The coverage area of burp cloth 10 may be based on typical adult sizes. In some embodiments, the symmetric shape (see FIG. 3) and the reversible layering of burp cloth 10 (see FIG. 4) may allow placement over either the left or right shoulder (see FIGS. 1 and 7). In other embodiments, an asymmetrical design may be employed, e.g., a design in which back portion 24 is smaller or larger than front portion 22, or a design in which back portion 24 is of a different shape than front portion 22.

Referring again to FIG. 1, the sleeve seam 18 may sit on the outside of the user's shoulder at or near a juncture between the upper arm 30 and shoulder 14, and the upper arm drape section 32 affixed to the seam 18 may extend partially down the user's arm to the user's mid-bicep 34, for example. Of course, the upper arm drape section 32 may have any desired length, such as one that may extend to the user's elbow or forearm region, for example. The burp cloth 10 may be designed without closure side seams (under arm and the side) or ties to keep the sleeve 32 more drapeable and balanced, and to make the use easier. In other embodiments, sleeve 32 may substantially or completely circumscribe the user's arm, e.g., in a tubular fashion like a traditional garment sleeve or via ties, snaps, hooks, buttons, magnets, hook and loop fasteners, or other suitable closures.

Figure 2:
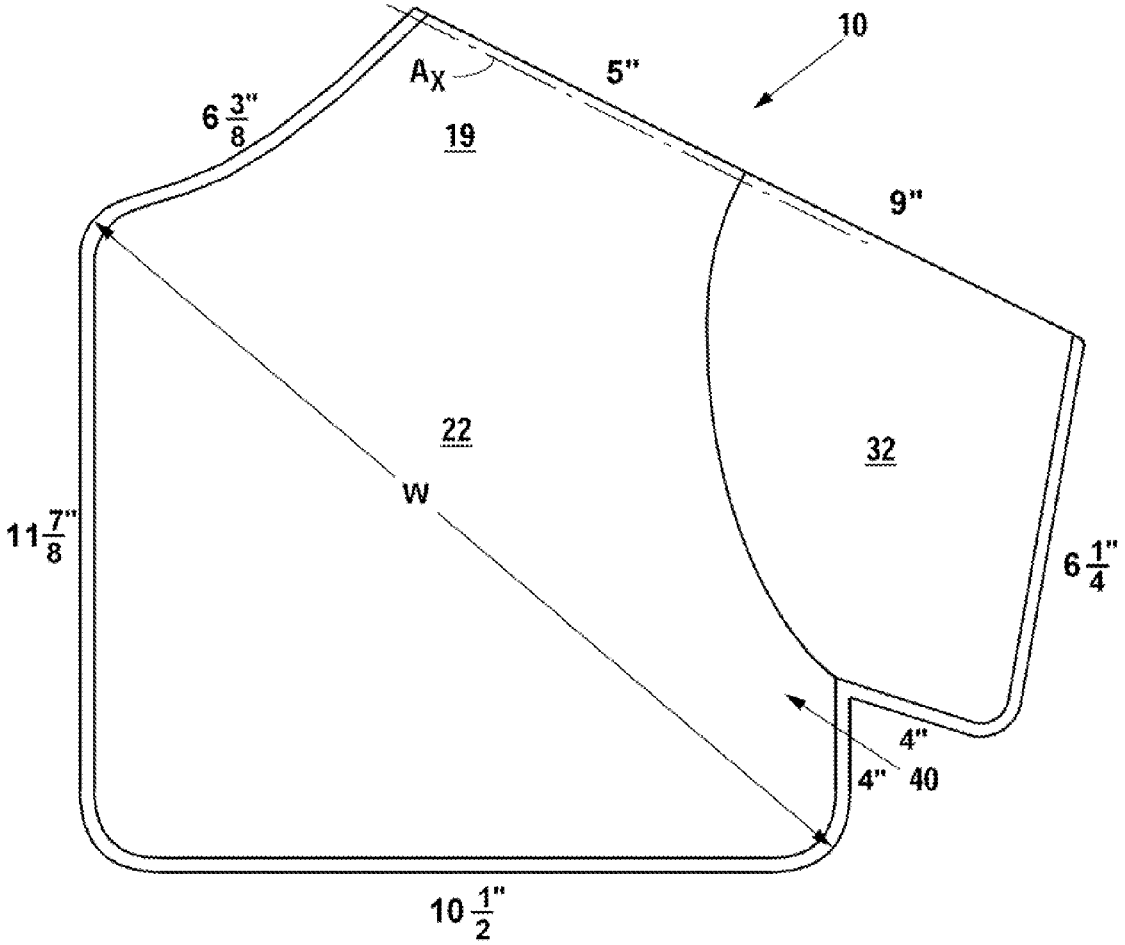
FIG. 2 is a front elevation view of the burp cloth of FIG. 1 shown in an "in-use" configuration.

In some embodiments, the burp cloth 10 may be symmetrical, so it will hang down on the front and back at an equal distance. As seen in FIG. 2, when the burp cloth 10 is in use, the width W of the front drape section 22 may extend from the middle of the chest (center front), across to the front side of the user. The width of the back drape section 24 may extend from the side back to the middle of the back. The length L (see FIG. 3) of the burp cloth 10 may extend from the pectoral/chest over the shoulder and terminate at the mid back/shoulder blade area. The burp cloth 10 may be designed to be non-directional, to make the use of the burp cloth 10 easy and effortless for the parent/user. This means that the burp cloth 10 may be used on the left or right shoulder of the user and either side of the burp cloth 10 may engage the user or face outward. When the user is trying to burp the baby, the large surface area of burp cloth 10 may provide plenty of coverage to keep the user dry and keep the baby comfortable. If the caregiver prefers to burp the baby in a different position, i.e., the baby sitting upright or laying the baby's belly on the user's lap, the caregiver 12 may place the burp cloth 10 on his/her lap then lay the baby on its belly and proceed with burping the baby. When using this position, the user may lay out the burp cloth 10 across the lap of the caregiver as shown, for example, in FIG. 3.

With the use of five layers of fabric, as described below, the burp cloth 10 may weigh more than an average cotton burp cloth. The weight per square inch of the body portion 40 of the burp cloth 10 may play an important role in keeping the burp cloth balanced and stable over the parent's shoulder. The upper arm drape section 32 of the burp cloth may have a weight per square inch that is less than the weight per square inch of the body portion 40, because the upper arm drape section 32 may contain fewer layers of fabric (e.g., two layers), whereas the body portion 40 may contain more layers (e.g., five layers, see FIG. 4). This design may keep the burp cloth 10 from becoming too heavy and may allow the upper arm drape section 32 to loosely "wrap" around the outer, upper portion of the user's arm, e.g., bicep region. When the caregiver is burping the baby, the fabric of burp cloth 10 may be absorbent enough to absorb a volume of bodily fluid that may discharge from the baby.

The appearance of the burp cloth 10 may be improved by changing the color, pattern, or texture by printing or embossing of an exposed top surface. This may improve the product esthetically and provide the consumers more choices to suit their personal needs and tastes.

FIG. 2 illustrates a detailed view of the burp cloth 10. In some embodiments, the fabric used to create the burp cloth 10 may be 100% cotton pique fabric. Pique fabrics are a type of dobby construction. Piques may be constructed in various patterns such as cord, waffle, and honeycomb. One exemplar fabric that may be used is a Birdseye pique. These pique fabrics include the addition of extra yarns, called stuffer yarns. The stuffer yarns are incorporated into the back of the fabric to give texture and added depth to the fabric design. By adding texture to the fabric, it creates absorbency and durability. One embodiment of the present baby sleeve consists of four layers of the Birdseye pique fabric. A second fabric is an inner anchor layer which is fabricated from a fluid-resistant or waterproof material, e.g., polyester/polyurethane laminate (PUL), or the like. PUL fabric is created by laminating lightweight polyester interlock knit fabric to a 1 mil. thick film of polyurethane. The characteristics of PUL are as follows: it is washable, waterproof, breathable, hypoallergenic, and made in the USA. Of course, other suitable fabrics may be used for the various layers of burp cloth 10, and the burp cloth fabric is not intended to be limited to the fabrics and/or burp cloth shown, but can be changed to accommodate various customers and needs.

Figure 4:
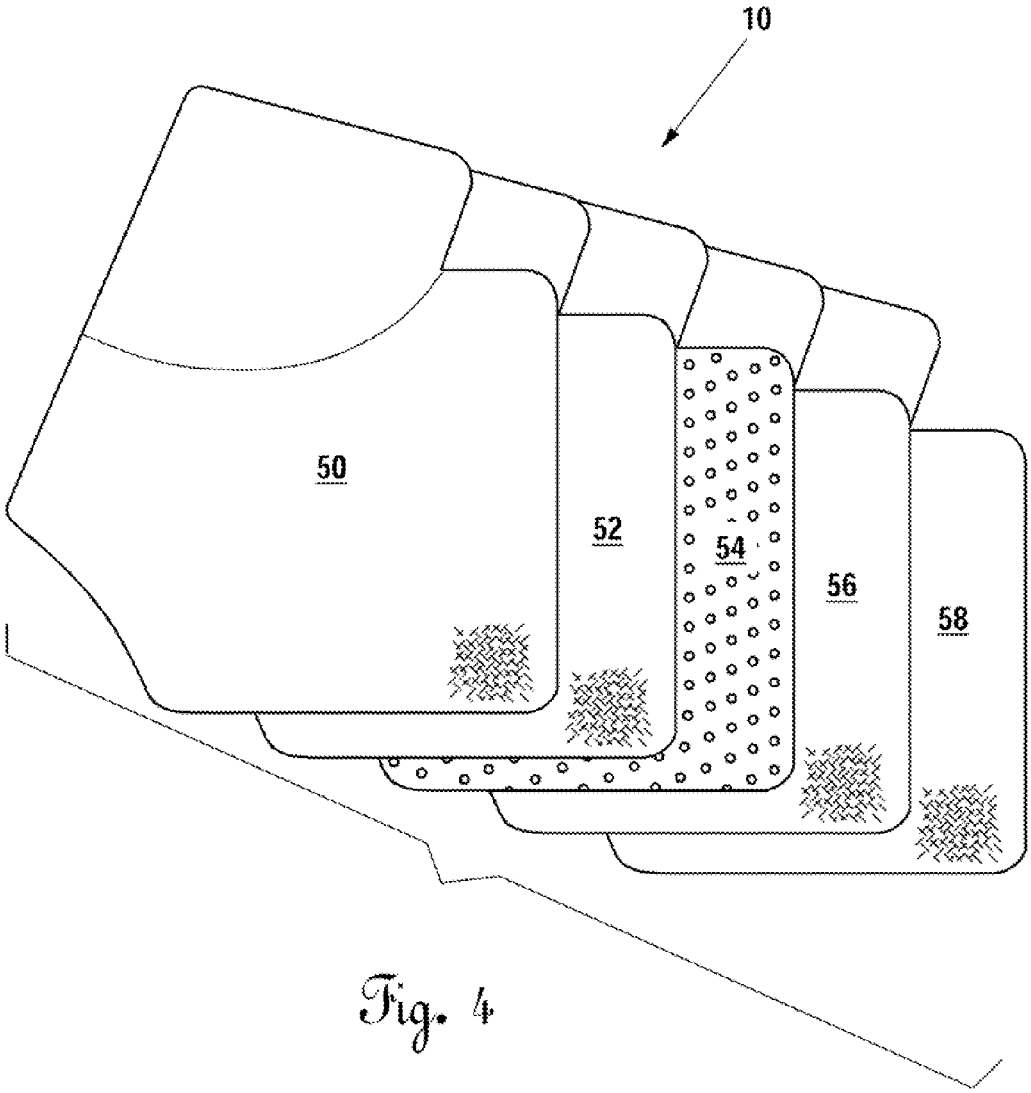
FIG. 4 is an exploded view of the burp cloth of FIG. 1 that illustrates multiple layers of the burp cloth.

In some embodiments, the body portion 40 of burp cloth 10 may have one layer of the PUL fabric, with two layers of the Birdseye fabric on each side of the PUL fabric (see FIG. 4, for example). The reason for using the PUL fabric is to create a waterproof barrier that keeps the user's clothes dry.

In some embodiments, the upper arm drape section (sleeve) 32 of the burp cloth 10 may include two layers of the Birdseye pique fabric. The upper arm drape section 32 may be designed to be lighter weight to help balance the burp cloth and have better drape ability. For these reasons, in some embodiments the upper arm drape section (sleeve) 32 may or may not include an inner layer of PUL fabric with only one layer of Birdseye pique fabric on each side of the PUL layer, for example.

Figure 5:
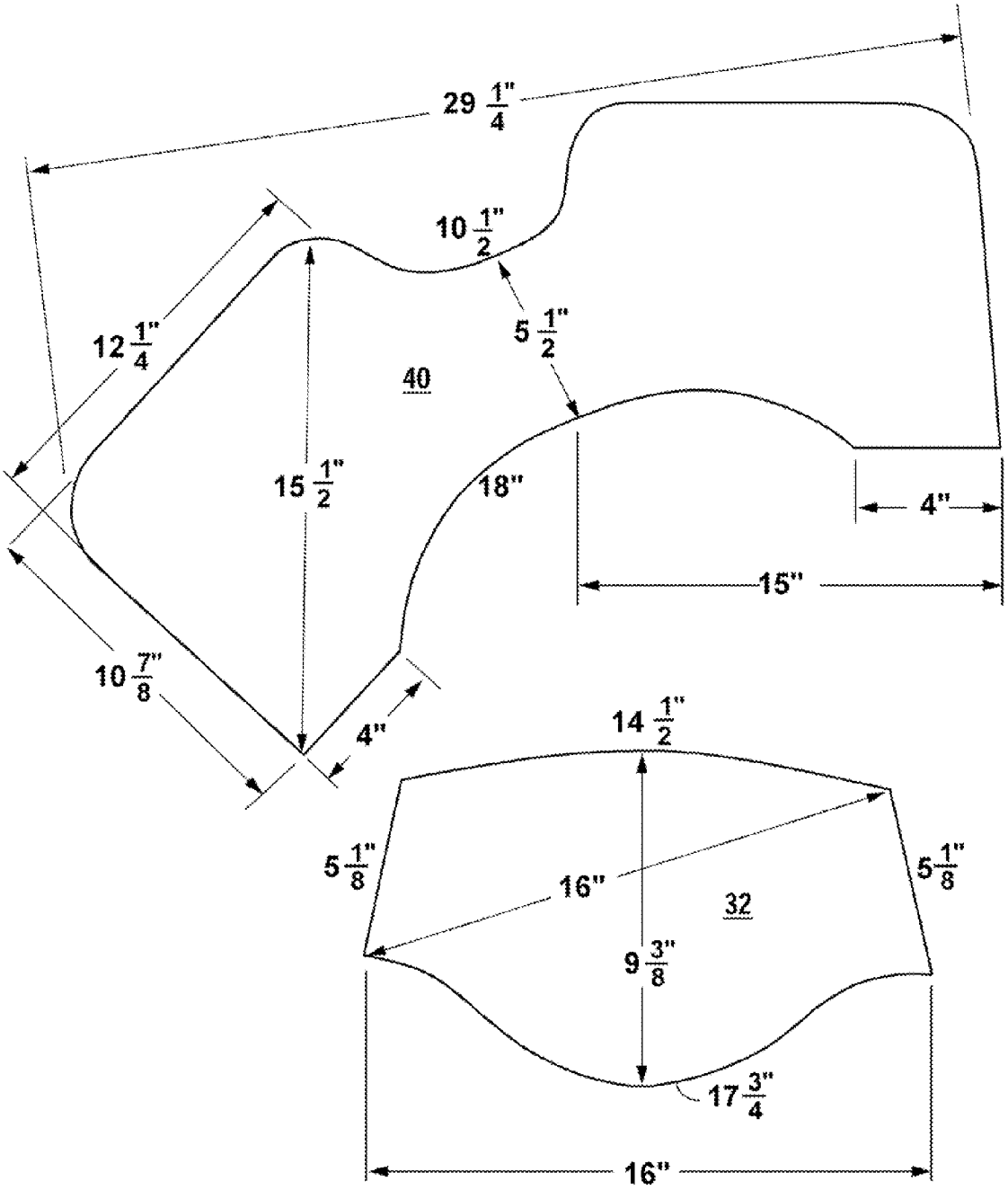
FIG. 5 is a top plan view of flat pattern pieces of the burp cloth of FIG. 1.

Referring to FIG. 5, in some embodiments, to construct the body portion 40 of burp cloth 10, the burp cloth body pattern may be cut four times using the Birdseye pique fabric. To construct the upper arm drape section 32, the upper arm drape section (sleeve) pattern may be cut twice using the cotton fabric. The polyester/polyurethane laminate (PUL) may be cut once for each pattern (body 40 and sleeve 32). Once the pattern pieces are cut out, and referring to FIG. 4, two outer burp cloth pieces 56, 58 are placed on top of each other. Next, the PUL inner fabric layer 54 is pinned to the first two outer layers 56, 58 of fabric. Then, the other two outer layers 50, 52 of the burp cloth pattern pieces are placed on top of the PUL fabric layer 54 and all five layers are pinned together. Once the body 40 of the burp cloth is pinned together, with right sides together, one sleeve 32 layer is pinned to the arm hole of the burp cloth matching at the shoulder notches, as customary in the art. With right sides together, the first sleeve layer is walked along the arm hole of the burp cloth, matching notches along the way as customary in the art. After that, the second sleeve layer 32 is taken with right sides together and pinned to the other side of the burp cloth arm hole, walking along the arm of the burp cloth matching notches along the way as customary in the art.

A preferred sewing machine that may be used to construct burp cloth 10 is a serger. The serger balances stitches to help construct durable seams, edgings, and finishes. A four-thread stitch may be used for the construction of the burp cloth 10; it creates the seam by using both needles and loopers of the machine. The right needle creates a safety stitch between the left needle and the edge of the fabric. When selecting serger thread, the thread color to the fabric is matched so that the thread will not be seen from the outside of the burp cloth. Of course, any suitable sewing machine or stitching pattern may be employed, and other methods of manufacture may be used, such as adhesive or heat fusing, for example.

In some embodiments, the sequence of construction for the burp cloth 10 may start with the sleeve seam 18. Using ¼" seam allowance measurement, the raw edge sleeve seam is placed next to the serger presser foot and sewn from the top of the sleeve to the bottom of the sleeve, following the notches along the way. The seam is finished and fastened off. The opposite sides of the sleeve are placed together, matching the edges, and pinned in place. By doing this, the seam just sewn is encased on the inside. Using the wide setting of the rolled hem stitch, starting at a corner of the burp cloth, the burp cloth is serged keeping the raw edge flush with the needle plate. The entire perimeter of the burp cloth is sewn around with the stitches exposed on the outside of the burp cloth. The stitches are close together for functional and design purposes. By keeping the serged edge exposed, the burp cloth is capable of laying flat on the caregiver. Further, it eliminates excessive bulk due to the several layers of fabric. The purpose of a serged seam is to create flexibility and durability. Again, however, as persons of skill in the art will understand, other suitable manufacturing methods may be used.

As seen in FIG. 2, in some embodiments the burp cloth 10 measures from the front side to the front chest about 10½" and from neck to the front bottom edge about 11⅞". The measurement for the neck starting from the front edge to the shoulder is about 6⅜". The measurement from the neck to the end of the shoulder is about 5". The sleeve measure from the edge of the shoulder to the mid-bicep is about 9". The length of the sleeve when folded is about 6¼". The length of the sleeve from under the arm measures about 4". The side of the burp cloth measures about 4". Of course, other suitable sizes may be used.

Figure 3:
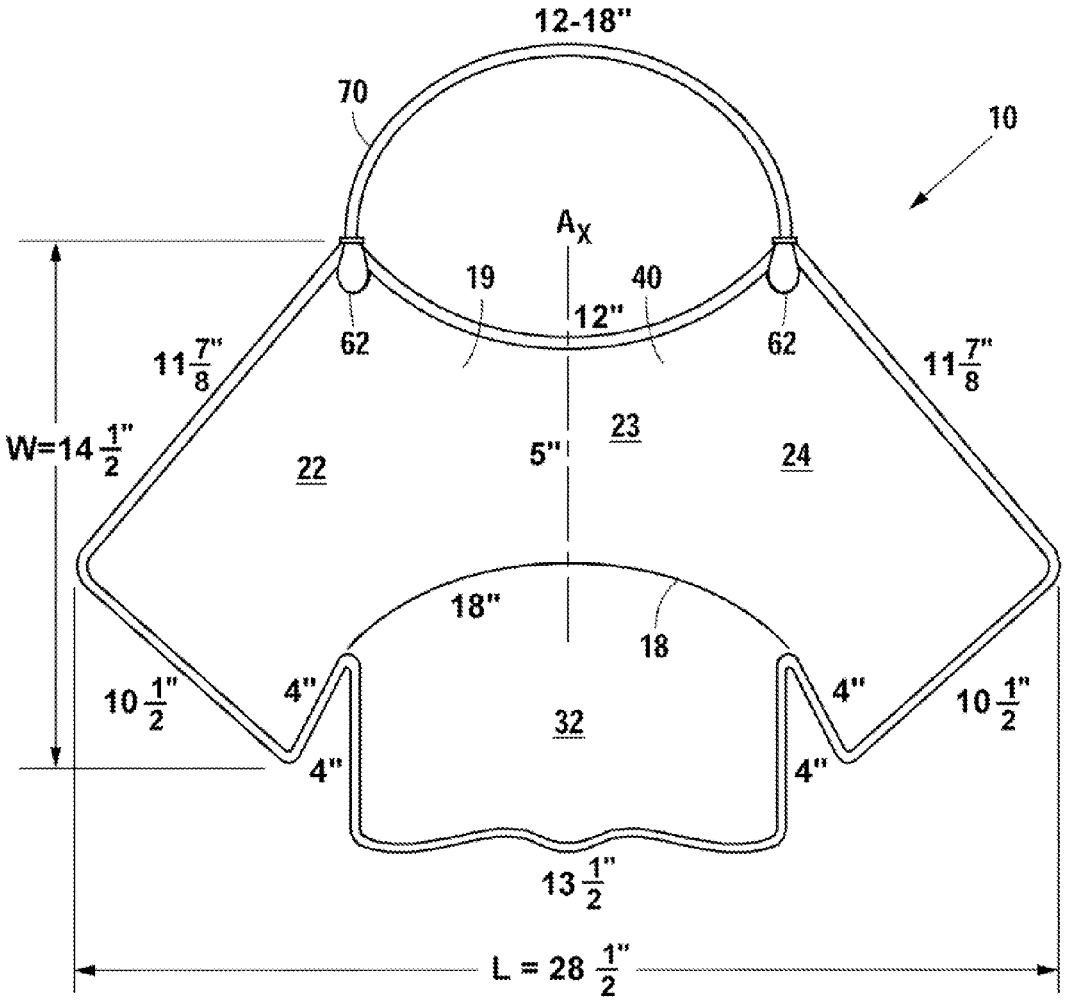
FIG. 3 is a top plan view of the burp cloth of FIG. 1 shown in a flat position.

Turning to FIG. 3, it may be seen how the burp cloth 10 looks when it is fully extended and laying on a flat surface or on a caregiver's lap. In some embodiments, the burp cloth fully extended measures about 28½" inches long from vertical end to end. The measurement for the bottom front edge is about 10½". The center front edge measurement of the burp cloth is about 11⅞". The neck line measurement is about 12¾". The center back edge measures about 11⅞". The back bottom edge measures about 10½". The side measures about 4". The sleeve cap measures about 18". The shoulder drape section 23 from the neck to the outer edge of the shoulder measures about 5". The width of the bicep sleeve measures about 13¾". The side of the bicep sleeve measures about 4". The burp cloth measured diagonally from the top front corner to the front bottom right corner is about 14½". Measuring the back of the burp cloth diagonally from the top back corner to the bottom back right corner is about 14½". The measurement from the shoulder to the front bottom edge is about 14¼". The measurement from the shoulder to the back bottom edge is about 14¼". The serged seam allowance of the burp cloth measures about ¼". Again, however, persons of skill in the art will understand that other suitable sizes may be used.

FIG. 4 illustrates the multiple layers of the burp cloth 10. This view shows how the burp cloth 10 may be made out of five layers of fabric, for example. The upper or outermost layer 50 of the burp cloth uses 100% absorbent Birdseye fabric. This layer is the first absorbent layer of the burp cloth. The second layer 52 of the burp cloth is also cotton Birdseye fabric. The second layer of the burp cloth functions as a buffer layer, this second layer helps to absorb the baby's bodily fluid faster so it will not run down the burp cloth and soil the parent's/caregiver's underlying garments. The third, innermost layer 54 of the burp cloth is polyester/polyurethane laminate (PUL). PUL, fabric is made by laminating lightweight polyester interlock knit fabric to a 1 mil. thick film of polyurethane. The next layer 56 uses Birdseye cotton fabric and this is also a buffer layer. Since the burp cloth is created to be reversible, this may also be viewed as a second layer. The last, outermost layer 58 of the burp cloth also uses Birdseye cotton fabric. Again, this layer is the last layer, but also may be viewed as a first layer, since the burp cloth is reversible. However, persons of skill in the art will understand that any suitable number and types of layers may be used.

In some embodiments, the upper arm drape section 32 (sleeve) is a multi-layer having only two layers of fabric. The first layer of the sleeve is the Birdseye cotton fabric. The second layer of the burp cloth sleeve is also cotton fabric. A PUL layer may or may not be included between the two cotton layers.

FIG. 5 illustrates the pattern pieces that comprise the burp cloth 10. The body portion 40 is created in one piece so as to drape over the caregiver's shoulder, chest and back. It is contoured by an arcuate portion to fit around the neck snugly while on the parent's shoulder and to maximize coverage. The body portion 40 is created to lay flat; it is designed without contouring, other than at the neck, and/or darts in the pattern. The body portion 40 of the pattern measured lengthwise from end to end is about 29¼". The width of the pattern on the bottom edge of the body element measures about 10⅞". The length of the burp cloth pattern measuring at the center front and center back is about 12¼". The contoured neck measurement is about 10½". The width of the shoulder seam measures about 5½". The front and back sides of the burp cloth measure about 4" in length. The arm hole of the burp cloth measures about 18". The diagonal measurement from the top corner edge to the bottom corner is about 15½". The measurement from the middle shoulder to the front bottom corner is about 15". This same or similar cut pattern may be used for the PUL layer as well as the cotton layers of body portion 40.

Still referring to FIG. 5, the second pattern piece is the upper arm drape section 32 (sleeve) pattern. The length of the bottom edge of the sleeve is about 14½". The measurement from the top sleeve corners is about 16". The measurement of the sleeve cap is about 17¾". The side of the sleeve measures about 5⅛". The width measurement of the sleeve cap is about 9⅜". The measurement from the top corner diagonally across to the bottom corner is about 16". In some embodiments, the sleeve pattern may be created to be an open sleeve; an underarm seam may not be included in the construction of the burp cloth. The sleeve cap of the burp cloth may be designed without the ease in the sleeve cap to create a closer fit to the parent, as will be understood by those skilled in the art.

Figure 6:
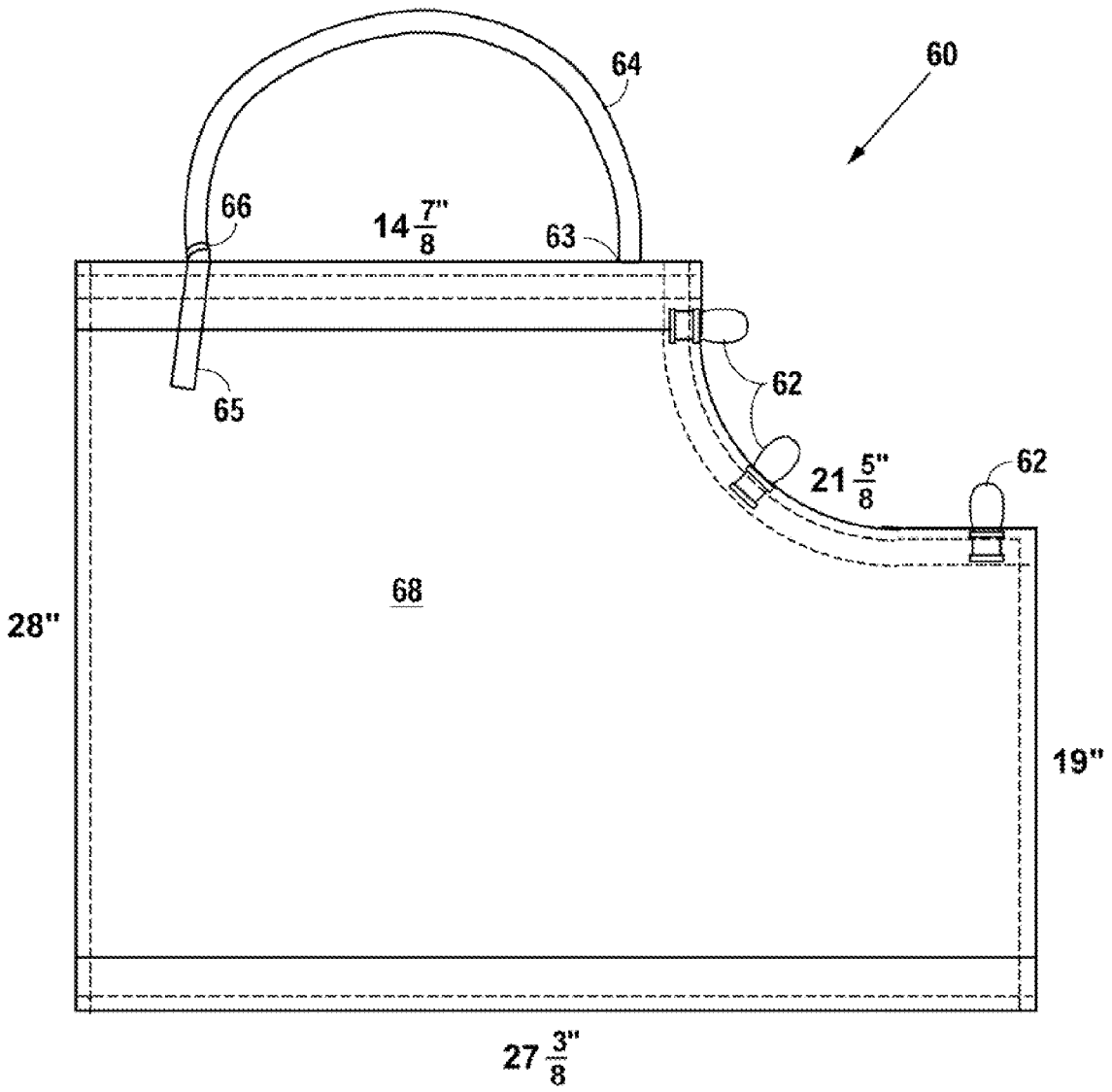
FIG. 6 is a front elevation view of a nursing cover attachable to the burp cloth of FIG. 1.

Referring to FIG. 6, a nursing cover 60 may be attachable to and detachable from burp cloth 10 (not shown, beneath nursing cover 60). Nursing cover 60 may be designed to clip to burp cloth 10 using three suspender clips 62, for example, which may be sewn or otherwise attached to nursing cover 60 or burp cloth 10. Of course, fewer or more than three clips may be used, and other suitable attachments may be used to attach nursing cover 60 to burp cloth 10, such as snaps, hooks, buttons, magnets, hook and loop fasteners, or other suitable attachments. The clips 62 may be placed along the curved side of nursing cover 60, for example, at the top corner, the middle, and the bottom to ensure nursing cover 60 stays in place while the mother is nursing. The curve of nursing cover 60 may approximate or substantially match the shape of burp cloth 10 to maximize coverage for the mother. The nursing cover 60 may be created out of 100% cotton or other suitable material to help keep the baby cool and to help with durability. Similar to burp cloth 10, the nursing cover 60 may be designed to be reversible, which means the mom does not need to worry about which side to use for the burp cloth 10 or the nursing cover 60. The appearance of the nursing cover 60 may be improved by changing the color, pattern, or texture by printing or embossing of an exposed top surface. This may improve the product esthetically and provide the consumers more choices to suit their personal needs and tastes.

Referring again to FIG. 6, when a nursing mother is wearing the nursing cover 60, an adjustable strap 64 may be placed around the neck of the mother to help the nursing cover 60 stay in place. Adjustable strap 64 may be made of cotton fabric or other suitable material, and one end 63 thereof may be sewn or otherwise attached to the body 68 of nursing cover 60 as shown. Nursing cover 60 may include a pair of D-rings 66 or other suitable device for adjustable attachment of the other end 65 of adjustable strap 64. The nursing cover 60 may lie across the front chest of the nursing mother to provide privacy while she is feeding her child. The nursing cover 60 may provide plenty of room for the mother and child; for example, it may be sized so as to start at about the collar bone and may come down to the natural waist/belly button area, depending on the stature of the mom, and it may also provide sufficient cover from side to side.

Still referring to FIG. 6, in some embodiments, the nursing cover 60 may be made of a fabric that is 100% cotton, for example, or other suitable material and may include embellished or designed fabric. In some embodiments, nursing cover 60 may include an inner layer of PUL material sandwiched between two or more cotton fabric outer layers. The nursing cover 60 may include two layers of fabric sewn together with a facing sewn in around the curve, for example, which may continue to the top of the nursing cover 60. As understood in the art, a facing is a lining at the edge of a garment and adds extra durability. A seam allowance of the nursing cover may be about ½ inch, for example, and it may be top stitched on the perimeter edge to help the cover lie flat. In some embodiments, the adjustable strap 64 may be sewn to the top of the nursing cover 60 and may be placed about six inches in from the side of the nursing cover 60, for example. Of course, other suitable sizing and configuration may be used. The suspender clips 62 may be placed on or near the top of the nursing cover 60 around the curve to keep the nursing cover 60 flush with the burp cloth 10.

To construct the nursing cover 60, the pattern of the nursing cover 60 may be cut twice; the facing pattern may be cut once; and one strap may be cut out of the same or different fabric. Once all of the pieces have been cut out, one may start construction by folding the strap fabric pattern in half, and using ½" seam allowance, starting to sew at one end and sewing the entire length of the strap. Next, place one side of the facing to the other side of one of the nursing cover 60 fabric pattern pieces and pin them in place. Then place the second nursing cover 60 pattern piece with the desired sides facing each other, and pin them in place. Continue on by placing the raw edge of adjustable strap 64 on the top edge of the cover at suitable notches, and pin them in place. Keep the adjustable strap 64 down towards the bottom of the nursing cover 60 so it will not be sewn into the nursing cover 60. Using ½ seam allowance, for example, start at the bottom corner of the nursing cover 60 and continue around the perimeter of the nursing cover 60, and stop about 2-3 inches from the beginning. Before sewing the nursing cover 60 closed, make sure all corners are clipped, rolled out to a crisp corner, and ironed in place. Once the nursing cover 60 is sewn closed and the seam allowance is pressed out, top stitch the nursing cover 60. Using an ⅛" inch seam allowance, for example, sew the entire perimeter of the nursing cover 60, then measure about an inch down from the first stitch and top stitch again. Lastly, sew the suspender clips 62 to the nursing cover 60. Using strips of fabric, match the clips 62 with suitable markings on the nursing cover 60 and sew them to the nursing cover 60. Of course, many alternative construction methods are available, and any suitable method of construction may be used, as will be appreciated by those skilled in the art.

The shape of the nursing cover 60 may be designed to be used with or without the burp cloth 10. In some embodiments, the measurements of the fabric pattern pieces for the nursing cover 60 may be as follows: the top measures about 16"; the bottom measures about 28"; the right side measures about 20"; the left side measures about 30"; and the curve measures about 22". The length of the strap 64 measures about 34", and the width of the strap 64 measures about 5". In some embodiments, when the nursing cover 60 is completely constructed, the measurements may be as follows: the top about 14⅞"; the bottom about 27⅜"; the right side about 19"; the left side about 28"; and the curve about 21⅝". The length of the strap 64 may be about 33", and the width of the strap 64 may be about 2¼". The seam allowance may be about ½"inch, with two top stitching seams that may measure about at ⅛" and 1"inch, respectively. Again, the sizing and configuration described herein are exemplary, not limiting, and persons of skill in the art will understand that any suitable sizing and configuration may be used.

Figure 8:
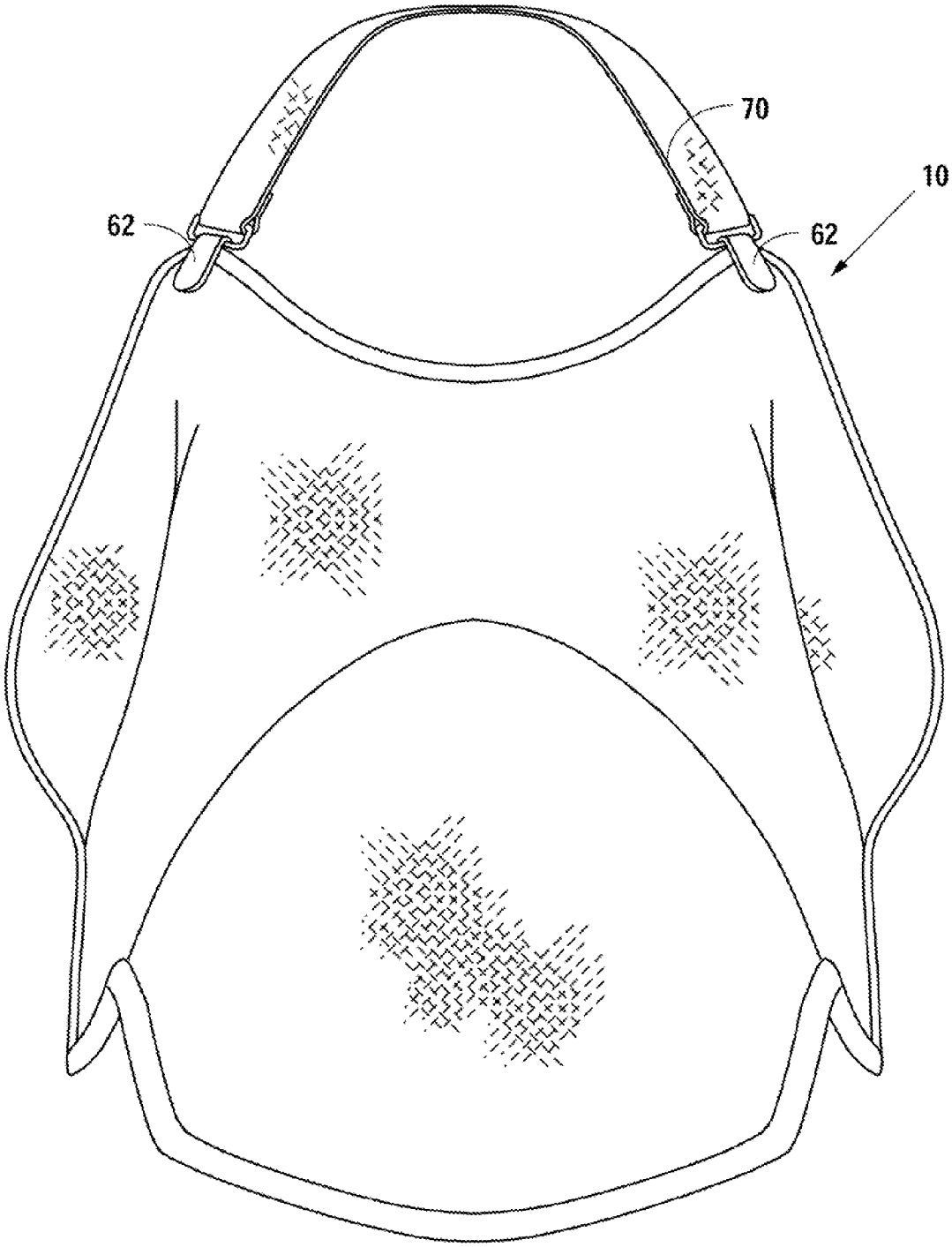
FIG. 8 is a front perspective view of a burp cloth draped on a mannequin in a nursing position.

As shown in FIGS. 3 and 8, in some embodiments, an adjustable strap 70 may be fastened to burp cloth 10 with clips 62 or other suitable fasteners. Adjustable strap 70 may be removably attachable to burp cloth 10 and configured to extend about the user's neck and hold burp cloth 10 in a nursing position across the user's chest, thereby forming a nursing cover. Thus, in this configuration, burp cloth 10 may be used as a nursing cover, as shown in FIG. 8.

The foregoing is considered as illustrative only of the principles of the invention. Further, since numerous modifications and changes will readily occur to those skilled in the art, it is not desired to limit the invention to the exact construction and operation shown and described. Those skilled in the art will recognize other embodiments of the invention which may be drawn from the illustrations and the teachings herein. To the extent that such alternative embodiments are so drawn, it is intended that they shall fall within the ambit of protection of the claims appended hereto.

Having disclosed the invention in the foregoing specification and accompanying drawings in such clear and concise manner, those skilled in the art will readily understand and easily practice the invention.

What is claimed is:

1. A symmetrical, reversible burp cloth comprising:

a multi-layered body portion having a first weight per square inch, a shoulder drape section, a front drape section, and a back drape section, each of said drape sections connected to form a shoulder saddle;

a sleeve seam extending along an edge of said shoulder saddle; and an upper arm drape section affixed to said sleeve seam and extending outwardly from said shoulder drape section and depending downwardly at least to a mid-bicep region of a user when said burp cloth is in use, said upper arm drape section having a second weight per square inch that is lesser than said first weight per square inch.

2. The burp cloth of claim 1 wherein said upper arm drape section has fewer layers than said body portion.

3. The burp cloth of claim 1 wherein said sleeve seam extends along an outer edge of said shoulder saddle and said shoulder saddle has an arcuate inner edge for contouring around a side portion of a user's neck when said burp cloth is in use.

4. The burp cloth of claim 1 further comprising a nursing cover removably attachable to said burp cloth, said nursing cover having a shape substantially matching a shape of said burp cloth.

5. The burp cloth of claim 1 further comprising an adjustable strap removably attachable to said burp cloth and configured to extend about the user's neck and hold said burp cloth in a nursing position across the user's chest, thereby forming a nursing cover.

6. A reversible burp cloth for protecting underlying user garments from soiling comprising:

a multiple-layered body portion having a first weight per square inch comprising:

a shoulder drape section, a front drape section and a back drape section;

said multi-layered body portion having a plurality of outer layers of cotton material surrounding a central layer of polyester/polyurethane laminate, said shoulder drape section adapted when said cloth is in use to align generally with a longitudinal axis of a middle part of said user's shoulder, said front drape section adapted when said cloth is in use to extend generally perpendicular from said longitudinal axis and forward from said middle part of said user's shoulder and depending downwardly to a front mid-chest region of said user, said back drape section adapted when said cloth is in use to extend generally perpendicular from said longitudinal axis and rearward from said middle part of said user's shoulder and depending downwardly to a mid-back region of said user, each of said shoulder, said front, and said back drape sections connected to form a shoulder saddle over said user's shoulder, said shoulder saddle having an arcuate inner portion for contouring around a portion of said user's neck; and a sleeve seam extending along an outer edge of said shoulder saddle; and an upper arm drape section, having fewer layers than said body portion and a second weight per square inch lesser than said first weight per square inch, affixed to said sleeve seam, said upper arm drape section configured to extend generally outwardly along said longitudinal axis of said middle part of said user's shoulder and depending downwardly to a bicep region of said user.

7. A reversible burp cloth comprising:

a body portion having shoulder, front, and back drape sections forming a shoulder saddle;

an upper arm drape section affixed to a sleeve seam along an outer edge of said shoulder saddle;

said body portion formed of a plurality of first fabric materials surrounding a central layer of polyester/polyurethane laminate;

said upper arm drape section having fewer layers than said body portion.

* * * * *